US005346724A

United States Patent [19]

Ohgake et al.

[11] Patent Number: 5,346,724

[45] Date of Patent: Sep. 13, 1994

[54] OIL AND FAT COMPOSITION FOR LUBRICATING FOOD PROCESSING MACHINES AND USE THEREOF

[75] Inventors: Ryoji Ohgake, Yachimata; Mitsuo Okada, Yokohama; Hiroyuki Takashima, Yamato; Teruo Shimizu, Omiya; Narihito Yamamoto, Minamisaitama, all of Japan

[73] Assignee: Nippon Oil Company, Ltd., Tokyo, Japan

[21] Appl. No.: 860

[22] Filed: Jan. 5, 1993

Related U.S. Application Data

[63] Continuation-in-part of Ser. No. 966,678, Oct. 26, 1992, abandoned, which is a continuation of Ser. No. 789,723, Nov. 8, 1991, abandoned.

[30] Foreign Application Priority Data

Apr. 12, 1991 [JP] Japan ..... 3-108370

[51] Int. Cl.[5] ..... B05D 3/02

[52] U.S. Cl. ..... 427/384; 427/421

[58] Field of Search ..... 427/384, 421

[56] References Cited

U.S. PATENT DOCUMENTS 2,015,867 10/1935 Noack .
3,928,401 12/1975 Sturwold et al. .
3,929,664 12/1975 Alburger ..... 252/301.2 P
4,023,912 5/1977 Mahler et al. ..... 401/82
5,034,144 7/1991 Ohgake et al. ..... 252/565
5,182,091 2/1993 Ogake et al. ..... 252/56.5

FOREIGN PATENT DOCUMENTS 62-000442 1/1987 Japan .
63-23837 2/1988 Japan .
63-51332 3/1988 Japan .
63-063343 3/1988 Japan .
8506396 9/1986 United Kingdom .

OTHER PUBLICATIONS

Hawley's Condensed Chemical Dictionary, 11th Ed., Van Nostend, Reinhold, N.Y., p. 297.

*Primary Examiner*—Janyce Bell
*Attorney, Agent, or Firm*—Millen, White, Zelano, & Branigan

[57] ABSTRACT

An oil and fat composition for food processing machines comprises polyglycerides of medium chain saturated fatty acids and/or mixed polyglycerides of medium chain saturated fatty acids and long chain saturated fatty acids and, optionally, triglycerides of medium chain saturated fatty acids. The composition is safe for food sanitation, has excellent oxidation stability and lubricating property and a suitable degree of viscosity and cloud point as well as a high viscosity and a low temperature fluidity which cannot be attained by MCT and is favorably utilized as lubricating oil for food processing machines and tools and agricultural machines and tools.

19 Claims, No Drawings

OIL AND FAT COMPOSITION FOR LUBRICATING FOOD PROCESSING MACHINES AND USE THEREOF

This application is a continuation-in-part of U.S. patent application Ser. No. 966,678, filed Oct. 26, 1992, now abandoned, which in turn is a continuation of U.S. patent application Ser. No. 789,723, filed Nov. 8, 1991,now abandoned.

BACKGROUND OF THE INVENTION

1. Field of the Invention

The present invention relates to a novel oil and fat composition and to methods for using it to lubricate machines and tools for agriculture and food processing and like machines and tools. More particularly, the present invention relates to a novel oil and fat composition for food processing machines which is safe for food sanitation, has excellent lubricating and antioxidation properties and is favorably utilized for machines and tools for food and agricultural products processing, like machines and tools, and items for food or agricultural products storage, preparation, cooking and handling.

2. Description of the Prior Art

For processing of agricultural products, livestock products, marine products and for preparation of food stuffs, various processes, such as selection, classification, grinding, mixing, baking, heating, fermentation, boiling, freeze drying and the like, are generally applied to the material and various kinds of food processing machines are utilized in these processes.

Examples of the machines for processing of agricultural products are machines and tools for collecting leaves from tea plants, rice cleaning machines, flour mills, brewing apparatus for production of sake, soy sauce, miso and the like and machines for the production of noodles, bread, cookies, fruit juice, jam, pickles and the like. Examples of machines for processing of livestock products are machines for processing milk, machines for production of milk products, such as cheese and butter, machines for processing meat and the like. Examples of machines for processing of marine products are machines for processing of fish meat, sea weeds and the like. Other examples of the food processing machines are apparatus for production of food additives, natural flavor and pharmaceutical products, such as a vacuum thin layer evaporator and a mixing apparatus.

For the purpose of lubrication of these food processing machines, oils of mineral origin, such as mineral oil and liquid paraffin, liquid vegetable oils, such as soy bean oil, cotton seed oil and rapeseed oil and animal oils and fats, such as beef tallow and lard are generally utilized. However, when oils of mineral origin are utilized, it is unavoidable that the oils are scattered or mixed into the foods or the agricultural products through rotating parts of the machines during long operation of the machines and the scattering and mixing of the oils of mineral origin into the foods and agricultural products are not desirable for food sanitation reasons. When liquid vegetable oils or animal oils and fats are utilized, oxidation stability is not sufficient even though they do not cause food sanitation problems.

The following oils and fats have been proposed as materials useful for food processing machines: (1) oil and fat utilized for spraying which comprises a transesterification product of 30 to 90 weight parts of oil and fat for foods containing less than 20 wt. % of saturated fatty acid and 70 to 10 weight parts of a composition containing a triglyceride of medium chain saturated fatty acids having 6 to 10 carbon atoms (MCT) as the main component (Laid Open Japanese Patent Publication Showa 56-72651); (2) a transesterification product of oil and fat made to contain increased amounts of monoene acids, such as oleic acid, and decreased amounts of polyene acids, such as linoleic acid and linolenic acid, by hydrogenation of vegetable oils, such as camellia oil, sasanqua oil, olive oil, safflower oil of high oleic acid content, hazelnut oil and rapeseed oil (Laid Open Japanese Patent Publications Showa 57-67695 and Showa 62-32841); (3) an oil of high oxidation stability and low cloud point which is prepared by transesterification of MCT and oil and fat of the vegetable oils described in (2) or hydrogenation products of oil and fats of the vegetable oils described in (2) (Laid Open Japanese Patent Publication Showa 61-173743).

However, the oils and fats of (1) through (3) contain large amounts of unsaturated acids such as oleic acid because they utilize soy bean oil, cotton seed oil, rapeseed oil, corn oil or oils which were made to contain increased amounts of oleic acid by reducing the content of polyene acids by hydrogenation to enhance oxidation stability. These oils have insufficient oxidation stability.

Another material proposed is a lubricating oil composition for food processing machines prepared by compounding triglycerides having linear alkyl group of 5 to 21 carbon atoms as the essential component and fatty acids of 12 to 22 carbon atoms (Laid Open Japanese Patent Publication Heisei 2-209995). However, this composition is based on the low viscosity MCT and has a problem that adjustment of the viscosity of the composition to a desired value is not always easy.

When vegetable oils are utilized as lubricating oils for food processing machines, they have problems that degradation of the oils takes place or seizure of machines takes place by hardening of the oils by polymerization because of unsaturated bonds in fatty acid molecules. The rate of oxidation of unsaturated fatty acids is larger than the rate of oxidation of saturated fatty acids. For example, the rates of oxidation of linoleic acid and linolenic acid at 20° C. are 12 to 20 times and 25 times, respectively, larger than the rate of oxidation of oleic acid. Esters of saturated fatty acids are stable against oxidation. For example, the rate of oxidation of methyl stearate at 100° C. is 1/11 and 1/100 of methyl oleate and methyl linoleate, respectively.

Oxidation stability and cloud point are, in general, related therefor each other. Oils and fats which contain larger amounts of unsaturated acids having higher oxygen absorption, such as oleic acid, linoleic acid and linolenic acid, in glyceride have lower oxidation stability and also a lower value of cloud point. Cloud point, pour point and solidifying point are also, in general, related therefore each other and a material having a higher cloud point has a higher pour point and a higher solidifying point. The properties of a material can be compared by utilizing either one of cloud point, pour point and solidifying point. An oil which is prepared by transesterification of MCT and an oil containing a large amount of oleic acid in which the contents of linoleic acid and linolenic acid are reduced by hydrogenation to enhance oxidation stability has a lower cloud point but is not sufficient in oxidation stability because oleic acid is also an unsaturated fatty acid.

Oils and fats containing larger amounts of saturated fatty acids having lower oxygen absorption, such as myristic acid, palmitic acid, stearic acid and the like, in glyceride have higher oxidation stability but higher cloud point at the same time.

Because lubricating oils are utilized for driving parts of various machines and tools, oils having viscosities suitable for each of the machines and tools are required. MCT which is considered to be the best material for the lubricating oil for food processing machines has satisfactory quality concerning high oxidation stability and low cloud point. However, MCT has too low viscosity when it is utilized without other components because the viscosity is 15 to 20 centipoises at 25° C. and 10 to 15 centipoises at 40° C.

SUMMARY OF THE INVENTION

An object of the present invention is to provide an oil and fat composition for food processing machines which is safe for food sanitation, has excellent oxidation stability, good lubricating properties and suitable degree of cloud point as well as a high viscosity and a low temperature fluidity which cannot be attained by MCT and is applied to driving parts of food processing machines and tools, such as chains and shafts, by dropping, by spraying as aerosol, by spraying with a pump and by the like methods.

Another object is to provide a method using the composition of this invention for such purposes.

Upon further study of the specification and appended claims, further objects and advantages of this invention will become apparent to those skilled in the art.

The oil and fat composition for food processing machines of the invention comprises a medium chain saturated fatty acid ester of a polyglycerol and/or a mixed fatty acid ester of a polyglycerol with a medium chain saturated fatty acid and a long chain saturated fatty acid and, optionally, a triglyceride of a medium chain saturated fatty acid.

DETAILED DESCRIPTION OF THE INVENTION

The present investors investigated extensively to prepare oil and fat compositions for food processing machines having the advantageous properties to achieve the objects describe above and discovered that an oil and fat composition comprising a medium chain saturated fatty acid ester of a polyglycerol (MCP) and/or a mixed fatty acid ester of a polyglycerol with a medium chain saturated fatty acid and a long chain saturated fatty acid (MLCP) and, optionally, a medium chain saturated fatty acid having 6 to 10 carbon atoms (MCT) is effective for achieving the object of the invention.

Thus, the present invention provides an oil and fat composition for food processing machines comprising a medium chain saturated fatty acid ester of a polyglycerol and/or a mixed fatty acid ester of a polyglycerol with a medium chain saturated fatty acid and a long chain saturated fatty acid and, optionally, a triglyceride of a medium chain saturated fatty acid.

The medium chain saturated fatty acid ester of a polyglycerol (MCP) is a polyglyceride prepared from a medium chain saturated fatty acid and polyglycerol. Examples of the medium chain saturated fatty acid are saturated fatty acids having 6 to 10 carbon atoms, such as caproic acid, heptylic acid, caprylic acid, nonylic acid, capric acid and the like. The medium chain saturated acid can be utilized singly or as a combination of two or more kinds.

The mixed fatty acid ester of a polyglycerol with a medium chain saturated fatty acid and a long chain saturated fatty acid (MLCP) is an ester of a mixed fatty acid comprising a medium chain saturated fatty acid and a long chain saturated fatty acid and a polyglycerol. Examples of the medium chain saturated fatty acid are the same as the examples of the medium chain saturated fatty acid for MCP described above. Examples of the long chain saturated fatty acid are lauric acid, myristic acid, palmitic acid, stearic acid and the like. The mixed fatty acid may be a mixture of more than one kind of fatty acids suitably selected from the group of the medium chain saturated fatty acids and the long chain saturated fatty acids or an oil prepared by saponification of extremely hardened oil which is prepared by hydrogenation of a vegetable oil, such as soy bean oil, rapeseed oil, palm oil, palm kernel oil, corn oil, coconut oil and the like, or animal fat and oil, such as lard, beef tallow, fish oil and the like. When the oil prepared by saponification of extremely hardened oil is utilized, it is preferable that coconut oil comprising various kinds of fatty acids, such as capric acid, caprylic acid, lauric acid, myristic acid, palmitic acid, stearic acid and the like, is utilized as the raw oil for hydrogenation.

MLCP can be prepared either by esterification of the mixed fatty acid with polyglycerol or by transesterification of MCP with the extremely hardened oil prepared by hydrogenation of the vegetable oils or animal fats and oils, preferably with the extremely hardened oil prepared from coconut oil.

The viscosity of MCP and MLCP can be adjusted by suitably selecting the saturated fatty acids utilized. The emulsifying property and compatibility with water are enhanced by leaving a suitable amount of unreacted hydroxyl group in glycerol by keeping the degree of saponification below a suitable level. This allows the composition of the invention to be washed off, when necessary, from food processing machines easily In general, MCP and MLCP have rather high viscosities. The viscosity can be adjusted to a desired level by mixing MCT according to necessity. MCT can be prepared from medium chain saturated fatty acids and glycerol. Examples of the medium chain saturated fatty acid are the same as the examples of medium chain saturated fatty acid for MCP.

Because the oil and fat composition for food processing machines of the invention does not comprise an unsaturated fatty acid component, it has excellent oxidation stability, suitable viscosity and cloud point, good lubricating properties and is safe for food sanitation. These properties make the compositions useful for lubricating machines and tools which may come into contact with food and also useful in food preparation.

To the oil and fat composition for food processing machines of the invention, antioxidants, such as tocopherol, 2,6-di-t-butyl-4-methylphenol and the like, fatty acids as the rust preventing and abrasion preventing oil agent and emulsifying agents to facilitate washing off the composition from food processing machines may be added as desired.

DESCRIPTION OF THE PREFERRED EMBODIMENTS

The compositions prepared were evaluated by the following methods.

(1) Oxidation stability: oxidation life in minutes at 120° C. was measured by the "method of testing of oxidation stability by a rotating bomb" according to Japanese Industrial Standard K-2514 3.3.

(2) Abrasion resistance: abrasion diameter in millimeters was measured under the condition of 1200 rpm, 15 kg, 30 min., according to the "wear preventive characteristics of lubricating fluid (four-ball method)" by ASTM D-4172.

(3) Rust preventing property: according to the "method of testing of rust preventing property of lubricating oil (the method of using distilled water)" by Japanese Industrial Standard K-2510.

(4) Viscosity: measured at 40° C. by using a B-type viscometer type BL, a product of Tokyo Keiki Co., Ltd.

(5) Cloud point: according to the standard method of analysis of oils and fats 2.3.7-71, by the Japanese Society of Oil and Fat Chemistry.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, and of corresponding application Japanese No. 108370/91, filed Apr. 12, 1991, are hereby incorporated by reference.

EXAMPLES

Examples 1 through 4

Oil and fat compositions shown in the following examples were prepared from a nona ester utilized as MCP which was prepared from a mixed fatty acid of 75 wt. % of caprylic acid and 25 wt. % of capric acid and decaglycerol and a triglyceride of a mixed fatty acid of 75 wt. % of caprylic acid and 25 wt. % of capric acid utilized as MCT.

| | Components in the composition (wt. %) | |
|---|---|---|
| | MCP | MCT |
| Example 1 | 100 | 0 |
| Example 2 | 90 | 10 |
| Example 3 | 60 | 40 |
| Example 4 | 40 | 60 |

Results of evaluation of the compositions are listed in Table 1.

Examples 5 through 7

A nona ester utilized as MCP which was prepared from a mixed fatty acid of 75 wt. % of caprylic acid and 25 wt. % of capric acid and decaglycerol and an extremely hardened oil based on rapeseed oil, an extremely hardened oil based on lard or an extremely hardened oil based on coconut oil were mixed in specified amounts and the mixture was dried until the mixture contained 100 ppm or less of water by bubbling nitrogen gas at 80° to 100° C. under stirring by a motor. To the dried mixture, 0.1 wt. % of sodium methylate as catalyst was added and the mixture was kept under stirring for about 30 minutes. After the catalyst was removed from the reaction mixture by washing with warm water, the mixture was bleached by activated clay and deodorized by vacuum distillation according to the generally practiced method. Thus, MLCP was prepared.

In Example 5, 90 wt. % of MCP and 10 wt. % of an extremely hardened oil based on rapeseed oil, in Example 6, 90 wt. % of MCP and 10 wt. % of an extremely hardened oil based on lard and in Example 7, 60 wt. % of MCP and 40 wt. % of an extremely hardened oil based on coconut oil, respectively, were treated by transesterification.

Results of evaluation of MLCP thus prepared as the compositions of the invention are listed in Table 1.

Comparative Examples 1 through 4

In Comparative Example 1, rapeseed oil, in Comparative Example 2, a triglyceride of a mixed fatty acid of 75 wt. % of caprylic acid and 25 wt. % of capric acid, in Comparative Example 3, liquid paraffin and, in Comparative Example 4, MCT, respectively, were evaluated by the same method as in the preceding examples. Results of the evaluation are listed in Table 1.

It is clearly shown in Table 1 that the compositions of the invention have excellent properties to achieve the object of the invention. In comparative examples in which the requirements of the invention are not satisfied, one or more of the properties are not satisfactory.

TABLE 1

| Example | oxidation stability, life, min | abrasion resistance, diameter, mm | rust preventing property | viscosity cp | cloud point |
|---|---|---|---|---|---|
| Example 1 | 142 | 0.32 | no rust | 180 | −10 or less |
| Example 2 | 195 | 0.38 | no rust | 130 | −10 or less |
| Example 3 | 234 | 0.40 | no rust | 50 | −10 or less |
| Example 4 | 336 | 0.44 | no rust | 30 | −10 or less |
| Example 5 | 129 | 0.34 | no rust | 170 | 2 |
| Example 6 | 145 | 0.35 | no rust | 160 | 2 |
| Example 7 | 158 | 0.39 | no rust | 120 | −10 or less |
| Comparative example 1 | 12 | 0.44 | no rust | 10 | −10 or less |
| Comparative example 2 | 600 | 0.52 | no rust | 12 | −10 or less |
| Comparative example 3 | 196 | 0.62 | rust | 10 | −10 or less |
| Comparative | 198 | 0.39 | no rust | 10 | −5.0 or less |

TABLE 1-continued

| Example | oxidation stability, life, min | abrasion resistance, diameter, mm | rust preventing property | viscosity cp | cloud point |
|---|---|---|---|---|---|
| example 4 | | | | | |

While the invention has been particularly shown and described with reference to preferred embodiments thereof, it will be understood by those skilled in the art that the foregoing and other changes in form and details can be made therein without departing from the spirit and scope of the invention.

To summarize the advantages obtained by the invention, the oil and fat composition for food processing machines is safe for food sanitation, has excellent oxidation stability and lubricating property and a suitable degree of viscosity and cloud point as well as a high viscosity and a low temperature fluidity which cannot be attained by MCT and can be applied to driving parts of food processing machines, such as chains and shafts, and to tools used for food preparation, by dropping, by spraying as aerosol, by spraying with a pump and by the like methods.

The oil and fat compositions of the invention can be applied to tools and containers for food preparation, storage and serving, to prevent sticking of the foods to the surface of the tools or containers. For example, the compositions can be sprayed into food storage or serving containers to prevent sticking of the food to these containers. Also, the compositions can be sprayed or otherwise applied to cooking surfaces to prevent sticking of the foods during cooking. Use of the compositions in cooking, particularly frying, can also prevent scorching of the foods being cooked. Further, the compositions can be applied to food cutting or slicing tool surfaces to improve the cutting or slicing ability without sticking which can damage the food shape or appearance.

Similarly, the compositions can be applied to the contact surfaces between food containers, servers or cooking implements. For example, the compositions may be applied between food service trays to prevent them from sticking together or to lids or covers of food containers or cooking implements to prevent them from sticking together and allow their easy removal.

The oil and fat compositions also find utility in their application to food or agricultural products handling and processing machines. Although lubricants or oils added to such machines are not applied to the food directly, it is inevitable that some of these lubricants or oils will come in to contact with the food or agricultural product. The inventors' compositions, thus, are useful for lubrication, cleaning, sludge prevention and rust prevention in such machines. For example, the compositions can be applied to driving chains and gears in such machines to provide lubrication to prevent sticking and prolong their useful life. Similarly, the compositions can be applied to conveyor parts, piston parts, bearings, rollers and roll guides, dividers, stirrers and any other moving part of such machines which require lubrication or non-stick properties. The compositions are also useful for application to the surfaces of such machines which come into contact with food or agricultural products to prevent sticking of the food or agricultural product.

An additional use of the compositions is in the cleaning of tablets containing food stuffs or agricultural products to prevent mold thereon.

In all of these applications the compositions of the invention provide in addition to excellent food sanitation, oxidation stability, lubricating and viscosity properties the advantages of non-sticking to food or agricultural products, rust prevention of the parts applied to and prolonged useful life of the parts applied to.

USE EXAMPLES

The following examples of use of the oil and fat compositions are intended to give an illustration of the invention and are not to be construed as limiting the invention or its scope.

Example 8 and Comparative Examples 5 through 7

In Example 8, an oil and fat composition comprising 40 wt. % of MCP (a nona ester prepared from decaglycerol and a mixed fatty acid comprising 75 wt. % of caprylic acid and 25 wt. % of capric acid) and 60 wt. % of MCT (a mixed fatty acid of triglycerol, the mixed fatty acid comprising 75 wt. % of caprylic acid and 25 wt. % of capric acid) was applied to a driving chain of a drying oven for production of instant Chinese noodles and operation of the drying oven was continued for 2 months. Condition of the driving chain of the drying oven after two months was evaluated on the items described below. Results of the evaluation are shown in Table 2. For comparison, three separate runs were made by the same method as in Example 8 except that MCT described above alone was used in Comparative Example 5, rapeseed oil was used in Comparative Example 6 and liquid paraffin was used in Comparative Example 7, respectively, in place of the oil and fat in Example 8. Results are also shown in Table 2.

Viscosity of Fresh Oil

Viscosity of fresh oil was measured at 40° C. according to "the testing method of kinematic viscosity" described in Japanese Industrial Standard K 2283.

Increase of Viscosity

After operation of the drying oven was continued for 2 months, lubricating oil sticking to the driving chain was taken as a sample and kinematic viscosity of the lubricating oil at 40° C. was measured. Increase of viscosity was calculated from the result of the measurement by the following equation:

increase of viscosity =
{[kinematic viscosity of used oil (@ 40° C.) − kinematic viscosity of new oil @ 40° C.)]/ kinematic viscosity of new oil (@ 40° C.)} × 100

Lubricating Property (Resistance to Seizure)

Generation of abnormal sound from the chain during operation of the drying oven for 2 months was examined and results were classified into the following 6 grades:

5: no generation of abnormal sound during 2 months.
4: generation of abnormal sound about once a month.
3: generation of abnormal sound once in 2 to 3 weeks.
2: generation of abnormal sound once in 1 to 2 weeks.
1: generation of abnormal sound once in 2 to 4 days.
0: generation of abnormal sound once a day or more.

Smell

Emission of smell from the driving chain after operation of the drying oven for 2 months was examined and heat and oxidation stability of the lubricating oil was evaluated from the results by classifying into the following 6 grades:
5: no smell at all.
4: only slight smell.
3: smell detected but little bad effect on foods.
2: smell with slight effect on foods.
1: smell with bad effect on foods.
0: bad odor with considerable effect on foods.

Rust Prevention Property

Formation of rust on the driving chain after operation of the drying oven for 2 months was examined and rust prevention property of the lubricating oil was evaluated from the result by classifying into the following 6 grads:
5: no rust at all.
4: only slight rust form.
3: rust formed but no effect on foods.
2: rust formed with slight effect on foods.
1: rust formed with bad effect on foods.
0: much rust with considerable bad effect on foods.

TABLE 2

| | viscosity of fresh oil (@ 40° C.) cSt | evaluation by an actual maching[1)] | | | |
|---|---|---|---|---|---|
| | | increase of viscosity % | lubricating property | smell | rust preventing property |
| Example 8 | 32 | 3 | 5 | 5 | 5 |
| Comparative Example 5 | 12 | 4 | 2 | 5 | 5 |
| Comparative Example 6 | 36 | >100[2)] | 5 | 1 | 1 |
| Comparative Example 7 | 32 | 22 | 3 | 2 | 0 |

[1)]Evaluation after operation for 2 months at an atmospheric temperature of 40° or less.
[2)]Evaluation was not possible because of solidification.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for lubricating parts of food or agricultural products processing machines and tools or surfaces of items for the storage, preparation, cooking or handling of food or agricultural products by applying to said parts or surfaces an oil or fat composition which comprises an ester of a medium chain saturated fatty acid of 6 to 10 carbon atoms and a polyglycerol and/or a mixed fatty acid ester of a polyglycerol, the mixed fatty acid being a medium chain saturated fatty acid of 6 to 10 carbon atoms and a long chain saturated fatty acid of more than 10 carbon atoms and, optionally, a triglyceride of a medium chain saturated fatty acid of 6 to 10 carbon atoms.

2. The method of claim 1 wherein the oil or fat composition is applied to a food storage, preparation, cooking or handling item to prevent sticking of the food to the item.

3. The method of claim 1, wherein the medium chain saturated fatty acid is caproic acid, heptylic acid, caprylic acid, nonylic acid or capric acid.

4. The method of claim 1 wherein the medium chain saturated fatty acid used to prepare the mixed fatty acid ester of a polyglycerol is caproic acid, heptylic acid, caprylic acid, nonylic acid or capric acid.

5. The method of claim 1 wherein the long chain saturated fatty acid used to prepare the mixed fatty acid ester of a polyglycerol is lauric acid, myristic acid, palmitic acid therefor stearic acid.

6. The method of claim 1, wherein the mixed fatty acid is a mixture prepared by saponification of an oil which is prepared by hydrogenation of a vegetable oil or an animal fat or oil.

7. The method of claim 6 wherein the mixed fatty acid is a mixture prepared by saponification of an oil which is prepared by hydrogenation of soy bean oil, rapeseed oil, palm moil, palm kernel oil, corn oil or coconut oil.

8. The method of claim 7, wherein the oil is coconut oil.

9. The method of claim 1 wherein the mixed fatty acid is a mixture prepared by saponification of an extremely hardened oil which is prepared by hydrogenation of lard, beef tallow or fish oil.

10. The method of claim 1, wherein the oil or fat composition comprises 50 to 100 weight percent of the ester of the medium chain saturated fatty acid and polyglycerol and 0 to 50 weight percent of the triglyceride of a medium chain saturated fatty acid.

11. The method of claim 1, wherein the oil or fat composition comprises 70 to 100 weight percent of the ester of the medium chain saturated fatty acid and the polyglycerol and 0 to 30 weight percent of the triglyceride of a medium chain saturated fatty acid.

12. The method of claim 1, wherein the oil or fat composition comprises 80 to 100 weight percent of the ester of the medium chain saturated fatty acid and the polyglycerol and 0 to 20 weight percent of the triglyceride of a medium chain saturated fatty acid.

13. The method of claim 1 wherein the oil or fat composition comprises 50 to 100 weight percent of the mixed fatty acid ester of a polyglycerol and 0 to 50 weight percent of the triglyceride of a medium chain saturated fatty acid.

14. The method of claim 1 wherein the oil or fat composition comprises 70 to 100 weight percent of the mixed fatty acid ester of a polyglycerol and 0 to 30 weight percent of the triglyceride of a medium chain saturated fatty acid.

15. The method of claim 1 wherein the oil or fat composition comprises 80 to 100 weight percent of the mixed fatty acid ester of a polyglycerol and 0 to 20 weight percent of the triglyceride of a medium chain saturated fatty acid.

16. The method of claim 1, wherein the oil or fat composition comprises 50 to 95 weight percent of the ester of the medium chain saturated fatty acid and the polyglycerol and 5 to 50 percent by weight of the mixed fatty acid ester of a polyglycerol.

17. The method of claim 1 wherein the oil or fat composition is applied dropwise or by spraying with an aerosol or by a pump.

18. The method of claim 1 wherein the oil or fat composition is applied to a driving part of a food processing machine.

19. The method of claim 18 wherein the driving part is a driving chain.

* * * * *